United States Patent [19]

Kako

[11] Patent Number: 4,928,655

[45] Date of Patent: May 29, 1990

[54] FUEL INJECTION CONTROLLER FOR AN INTERNAL COMBUSTION ENGINE

[75] Inventor: Hajime Kako, Himeji, Japan

[73] Assignee: Mitsubishi Denki Kabushiki Kaisha, Tokyo, Japan

[21] Appl. No.: 358,116

[22] Filed: May 30, 1989

[30] Foreign Application Priority Data

Jun. 15, 1988 [JP] Japan ..... 63-147278

[51] Int. Cl.[5] ..... F02D 41/18; F02D 41/28

[52] U.S. Cl. ..... 123/488; 123/494; 73/118.2; 364/431.05

[58] Field of Search ..... 123/480, 488, 494; 73/118.2; 364/431.05, 510

[56] References Cited

U.S. PATENT DOCUMENTS

| | | | |
|---|---|---|---|
| 4,428,348 | 1/1984 | Takase et al. | 364/431.05 X |
| 4,602,324 | 7/1986 | Fujawa et al. | 364/431.05 X |
| 4,688,425 | 8/1987 | Kanehara et al. | 73/118.2 X |
| 4,747,387 | 5/1988 | Takao et al. | 123/488 X |
| 4,757,793 | 7/1988 | Shimomura et al. | 123/488 |
| 4,807,151 | 2/1989 | Citron | 73/118.2 X |
| 4,807,581 | 2/1989 | Nishikawa et al. | 73/118.2 X |
| 4,844,042 | 7/1989 | Osano | 123/488 X |
| 4,848,301 | 7/1989 | Hashimoto et al. | 123/488 X |

OTHER PUBLICATIONS

Digital Signal Processing, Dr. Shinji Ozawa, Jikkyo Publishing Co., pp. 103–109, Jul. 10, 1979.

*Primary Examiner*—Willis R. Wolfe

*Attorney, Agent, or Firm*—Sughrue, Mion, Zinn, Macpeak & Seas

[57] ABSTRACT

A fuel control apparatus for an engine uses an N-bit low-resolution A/D converter to convert the analog output of an air intake pressure sensor. The N-bit output of the converter is multiplied by a prescribed constant to obtain a signal having at least (N+1) bits. The (N+1) bit signal is subjected to low-pass digital filtering and is used by a controller to calculate the pulse width to be applied to a fuel injector. A high resolution can be obtained using an inexpensive N-bit A/D converter.

3 Claims, 5 Drawing Sheets

FUEL INJECTION CONTROLLER FOR AN INTERNAL COMBUSTION ENGINE

BACKGROUND OF THE INVENTION

This invention relates to a fuel injection controller for an internal combustion engine which controls the amount of fuel which is injected into an engine based on the air pressure within the intake pipe of the engine. More particularly, it relates to a fuel injection controller which employs an inexpensive, low-resolution A/D converter.

A conventional fuel injection controller for an internal combustion engine has an air pressure sensor which senses the air pressure within the intake pipe of the engine and generates a corresponding analog output signal. This output signal is converted into a digital pressure signal by an A/D converter, and based on the value of the digital pressure signal and other parameters, a control unit controls the operation of fuel injectors so as to obtain a suitable air/fuel ratio.

During idling of a typical engine, the pressure in the air intake pipe is around 250 mm Hg. In order to detect the air pressure with a resolution of 1% or less, the resolution of the A/D converter must be at most 2.5 mm Hg/bit. If the full-scale reading of the A/D converter is to be 950 mm Hg, the A/D converter must generate an output having at least 9 bits. However, 9-bit A/D converters are not generally available on the market, so instead, a conventional fuel injection controller employs a 10-bit A/D converter, which is easily obtainable.

However, a 10-bit A/D converter is expensive, and therefore a conventional fuel injection controller is also expensive.

SUMMARY OF THE INVENTION

Accordingly, it is an object of the present invention to obtain a fuel injection controller for an internal combustion engine which can perform high-resolution control, particularly during idling, but which employs an inexpensive, low-resolution A/D converter.

In a fuel injection controller for an engine according to the present invention, the analog pressure signal from a pressure sensor is converted into a digital pressure signal by a low-resolution A/D converter having N bits. The output signal of the N-bit A/D converter is then multiplied in a multiplying device by a prescribed value n to obtain a digital signal having at least N+I bits. The output of the multiplying device is then passed through a low-pass digital filter, and based on the filtered output, a control unit calculates the amount of fuel to be injected into the engine.

In this manner, a high-resolution of at least (N +1) bits can be obtained using a low-resolution A/D converter having a resolution of only N bits.

There is no restriction on the values of N and n, but in a preferred embodiment, N is 8 and n is 4. With these values, an inexpensive 8-bit A/D converter can provide a resolution of 10 bits.

DESCRIPTION OF THE PREFERRED EMBODIMENT

Figure 1:
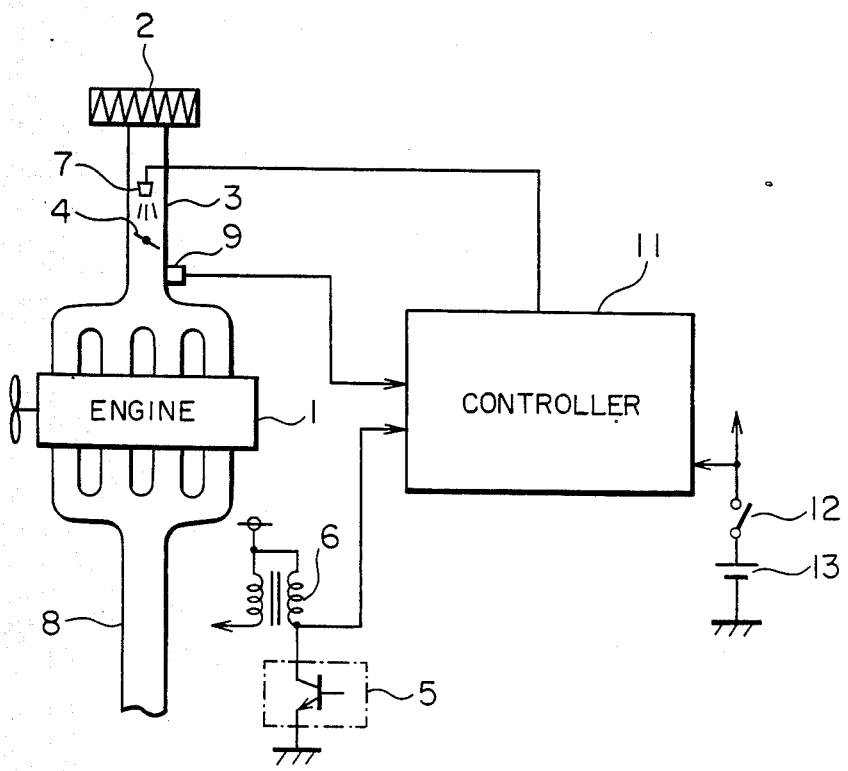
FIG. 1 is a schematic diagram of an embodiment of a fuel injection controller according to the present invention as applied to an internal combustion engine.

Hereinbelow, a preferred embodiment of the present invention will be described while referring to the accompanying drawings. FIG. 1 is a schematic diagram of an internal combustion engine which is equipped with an embodiment of the present invention. As shown in this figure, an engine 1 which is mounted on an unillustrated vehicle sucks in air through an intake pipe 3 on which are mounted an air cleaner 2 and a throttle valve 4. At the time of ignition, an igniter 5 is switched from on to off by a signal from an unillustrated signal generator within an unillustrated distributor. When the igniter 5 is switched off, a high-voltage ignition signal is generated in the secondary side of an ignition coil 6, and this ignition signal is supplied to unillustrated spark plugs of the engine 1 to produce ignition. In synchrony with the generation of this ignition signal, fuel is injected by a fuel injector 7 into the air intake pipe 3 upstream of the throttle valve 4. The injected fuel is sucked into the engine 1 by the above-mentioned sucking action. After the fuel is combusted, exhaust gas is discharged to the outside of the engine 1 through an exhaust manifold 8.

The pressure in the air intake pipe 3 at a point downstream of the throttle valve 4 is detected by a pressure sensor 9 which generates an analog output signal corresponding to the absolute pressure. This analog signal and a primary side ignition signal from the igniter 5 are input to a fuel injection controller 11 according to the present invention.

Figure 2:
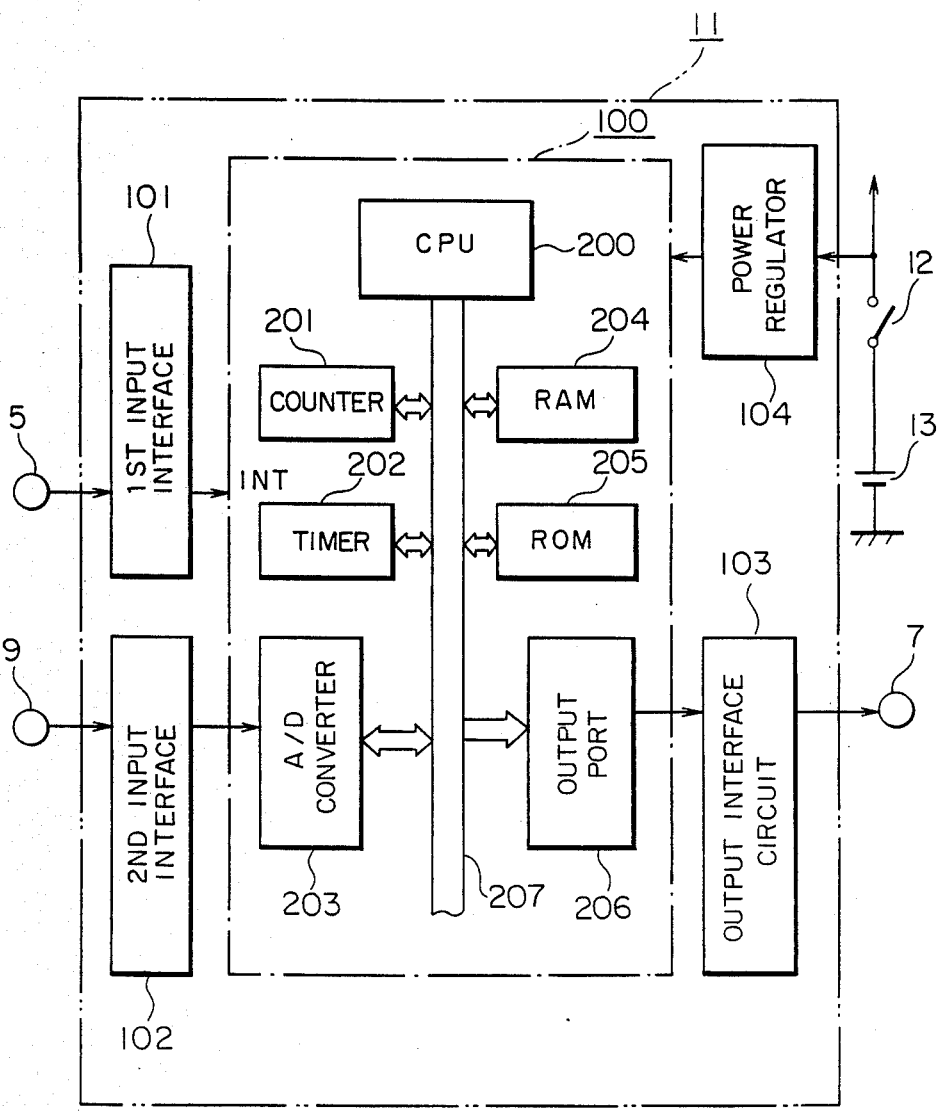
FIG. 2 is a block diagram of the control unit of FIG. 1.

FIG. 2 is a block diagram of the controller 11. As shown in this figure, the controller 11 is equipped with a microcomputer 100 having a CPU 200, a counter 201, a timer 202, an 8-bit A/D converter 203, a RAM 204, a ROM 205 which stores the programs executed by the CPU 200, an output port 206, and a bus 207 which connects the preceding elements. The primary side ignition signal from the igniter 5 undergoes waveform shaping in a first interface circuit 101 and the resulting signal is input to the microcomputer 100 as an interrupt signal. When an interrupt takes place, the period of the ignition signal is read in from the counter 201 and is stored in the RAM 204 to be used for calculating the rotational speed of the engine. The analog output signal of the pressure sensor 9 undergoes waveform shaping in a second interface circuit 102 and simultaneously has noise removed therefrom, after which it undergoes A/D conversion in the 8-bit A/D converter 203. The CPU 200 calculates the fuel injector opening time (the length of time for which the fuel injector 7 is open), which determines the amount of fuel to be injected. The calculated value for the opening time is then set in the timer 202, either as it is or after first undergoing correction. When the timer 202 is operated, a voltage having a prescribed level is output from the output port 206, it undergoes voltage-current conversion in the output interface circuit 103, and it opens the injector 7. The microcomputer 100 receives a constant voltage from a battery 13 via a key switch 12 and a voltage regulator 104.

Figure 3:
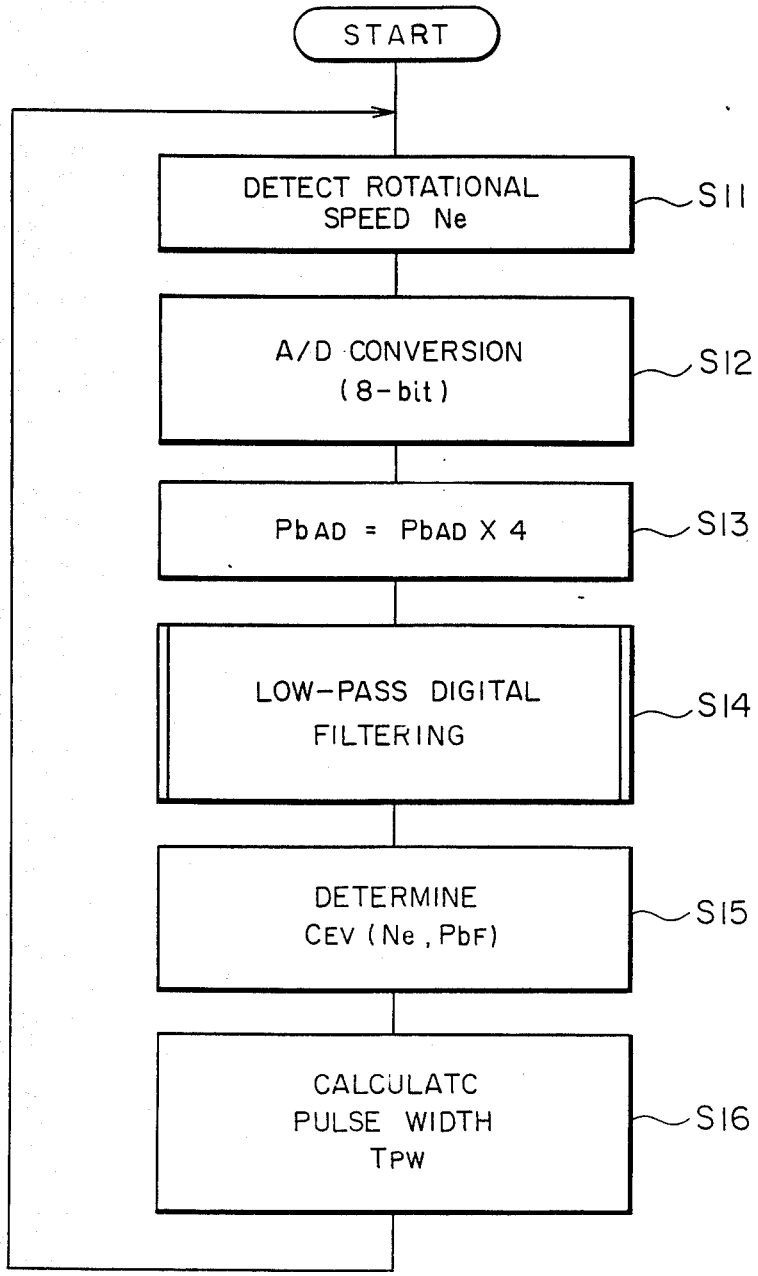
FIG. 3 is a flow chart of the main program executed by the control unit of FIG. 2.

Next, the operation of the CPU 200 will be described while referring to FIG. 3, which illustrates a program for calculating the width of pulses to be applied to the fuel injector 7. This program is stored in the ROM 205. In Step S11, the rotational speed Ne of the engine is calculated from the measured value of the period of the ignition signal and is stored in the RAM 204. In Step S12, the analog output signal from the pressure sensor 9 is converted into an 8-bit digital signal by the A/D converter 203 and is stored in the RAM 204 as an A/D-converted air intake pressure value PbAD. In Step S13, the 8-bit pressure value PbAD is multiplied by a predetermined constant, which in this case is 4, to give a new pressure value PbAD having 10 bits. The pressure value PbAD contains ripples due to pulsations which occur during air intake, and so in order to stabilize control, the pressure value PbAD undergoes low-pass filtering as shown in FIG. 7. This secondary low-pass digital filtering is performed in Step S14 and a filtered pressure value PbF is determined. The ROM 205 contains a two-dimensional map which gives experimentally-determined values of the volumetric efficiency CEV as a function of the rotational speed Ne and the filtered pressure value PbF. In Step S15, this two-dimensional map in the ROM 205 is mapped using the rotational speed Ne and the filtered pressure value PbF, and the volumetric efficiency CEV(Ne, PbF) is calculated for a predetermined air-fuel ratio. In Step S16, the pulse width Tpw which is necessary in order to supply the suitable amount of fuel to the engine 1 is calculated using the equation $Tpw=K\times PbF\times CEV$, wherein K is a constant. Step S11 is then returned to, and the above-described operation is repeated. The calculated pulse width Tpw is then set in the timer 202 in synchrony with the generation of an ignition signal, either as it is or after undergoing correction, and the timer 202 is operated.

Next, the low-pass digital filter which performs the filtering of Step S14 will be described. It will be assumed that a transfer function corresponding to a desired transfer function H(s) of an analog filter is to be obtained. Its frequency characteristics are given by $H(j\omega_A)$. The frequency characteristics $HD(e^{j\omega}D^T)$ of the system function $H_D(z)$ of a digital filter which can map the imaginary axis $s=j\omega_A$ of the s plane onto a unit circle in the z plane clearly has the same value as $H(j\omega_A)$.

The relationship between the frequency $\omega_A$ of an analog filter and the frequency $\omega_D T$ of a digital filter is determined by a mapping function, but the simplest function which can map the imaginary axis onto a unit circle is $$s=(z-1)/(z+1) \tag{1}$$

The relationship between $\omega_A$ and $\omega_D$ is given by $j\omega_A=(e^{j\omega}D-1)/(e^{j\omega}D^T+1)$ which can be expressed as $$\omega_A=\tan(\omega_D T/2)$$

If the sampling period $T=6\times10^{-3}$ sec, the cut-off frequency fc=5 Hz, and $Q=1/\sqrt{2}$, then the transfer function of the secondary low-pass digital filter is $$H(s)=\omega_A^2/(s^2+\sqrt{2}\,\omega_A\cdot s+\omega_A^2) \tag{2}$$

wherein $\omega_A=\tan(2\pi f_c.T/2)=0.0945$

If Equation 2 is combined with Equation 1, then the following equation is obtained:

$$H(z)=g_k[1+2z^{-1}+z^{-2}]/[1-e_k.z^{-1}-f_k z^{-2}] \tag{3}$$

wherein $$g_k=\omega_A^2/(1+\sqrt{2}\,\omega_A+\omega_A^2)=0.00782$$

$$e_k=2(1-\omega_A^2)/(1+\sqrt{2}\,\omega_A+\omega_A^2)=1.735$$

$$f_k=-(1-\sqrt{2}\,\omega_A+\omega_A^2)/(1+\sqrt{2}\,\omega_A+\omega_A^2)=-0.766$$

Figure 4:
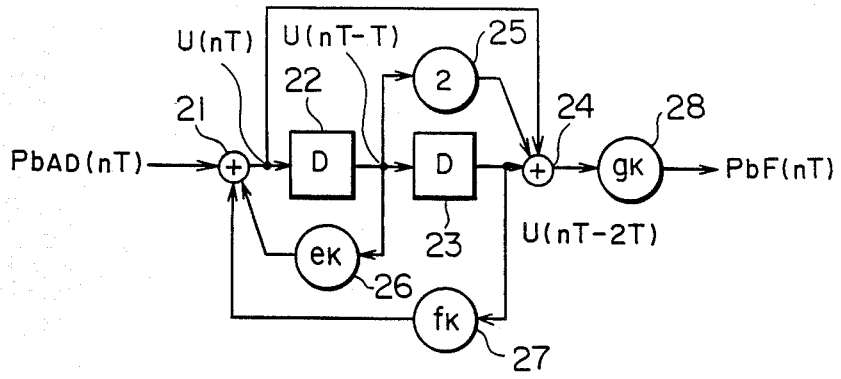
FIG. 4 is a block diagram of a low-pass digital filter.

FIG. 4 is a block diagram of the relationship of Equation 3. In FIG. 4, 21 and 24 are adders, 22 and 23 are elements which produce a time delay of T sec, 25 is a coefficient multiplying circuit, 26 is a circuit which multiplies by coefficient $e_k$, 27 is circuit which multiplies by coefficient $f_k$, 28 is a circuit which multiplies by coefficient $g_k$, PbAD(nT) is the pressure value for the nth sampling, PbF(nT) is the filtered pressure value corresponding to the nth sampling, and U is an intermediate variable. U(nT) indicates the present value, U(nT −T) indicates the previous value, and U(nT −2T) indicates the next to previous value of the intermediate variable U.

The following equations express the relationship of FIG. 4 as difference equations:

$$\left.\begin{aligned} PbF(nT) &= g_k\cdot\{U(nT)+2U(nT-T)+U(nT-2T)\}\ldots(4a)\\ U(nT) &= PbAD(nT)+e_k\cdot U(nT-T)+f_k\cdot U(nT-2T)\ldots(4b)\end{aligned}\right\} \tag{4}$$

Figure 5:
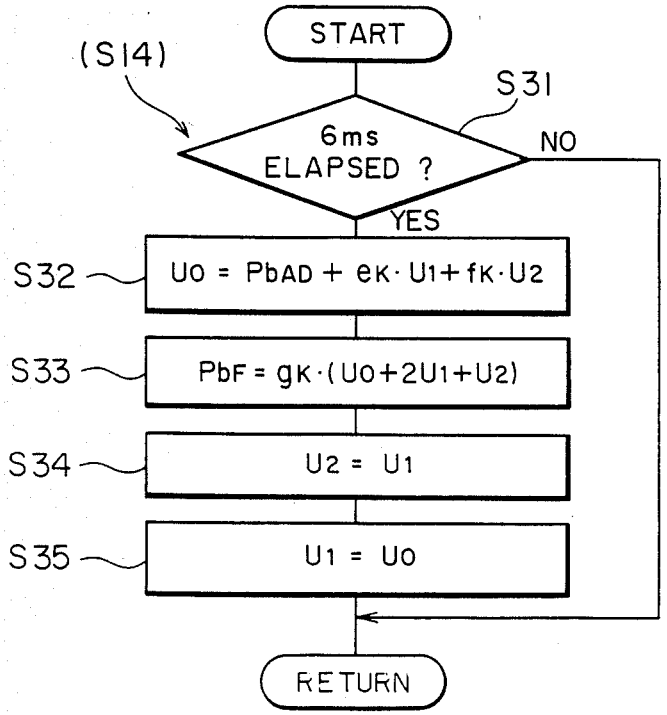
FIG. 5 is a flow chart of a program executed by the controller to perform digital filtering.

FIG. 5 is a flow chart illustrating the method by which Equation 4 is calculated. In this example, sampling is performed every 6 msec, so in Step S31, it is determined whether 6 msec have elapsed since the last sampling. If it is not yet time to perform sampling, then a return is executed, and Step S15 of FIG. 3 is performed. If 6 msec have elapsed, then in Step S32 the value of the intermediate variable $U_0$ is found as in Equation 4b by the equation $U_o=PbAD+e_k.U_1+f_k\times U_2$ using the present pressure value PbAD, coefficients $e_k$ and $f_k$, and the previous and next to previous values of the intermediate variables $U_1$ and $U_2$. In Step S33, as shown in Equation 4a, the present value of the filtered pressure value PbF is found from the equation $PbF=g_k\times(U_0+2U^1+U_2)$ using the present, the previous, and the next to previous values of the intermediate variables $U_0$, $U_1$, and $U_2$ and coefficient $g_k$. The result is stored in the RAM 204. In Step S34, the previous intermediate variable $U_1$ is stored in the RAM 204 as the next to previous intermediate variable $U_2$. In Step S35, the present intermediate variable $U_0$ is stored in the RAM 204 as the previous intermediate variable $U_1$, and then Step S15 of FIG. 3 is performed.

Figure 6:
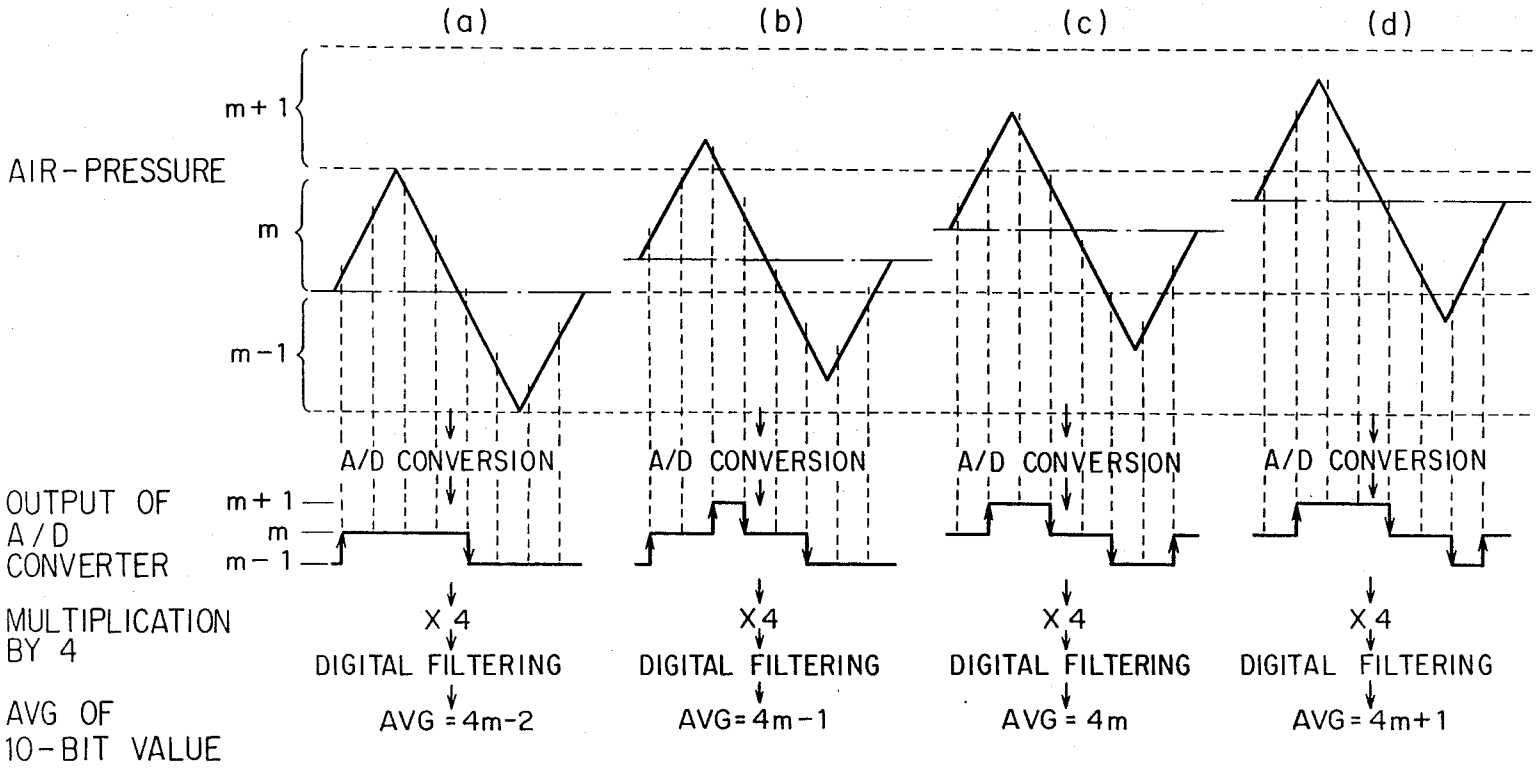
FIG. 6 is a waveform diagram of the output signals of the pressure sensor and the A/D converter of the embodiment of FIG. 1.

Next, while referring to FIG. 6, it will be explained how the 8-bit pressure value which is generated by the A/D converter 203 becomes a 10-bit filtered pressure value with a resolution of 10-bits. In this figure, m−1, m, and m+1 indicate the outputs of the 8-bit converter 203 corresponding to the measured air pressure. The air intake pipe pressure signal (the analog signal before A/D conversion) is approximated by a triangular wave having a peak-to-peak amplitude corresponding to two bits of the output of the A/D converter 203. The digitalized value (the pressure value) and the low-pass digital filtered value (the filtered pressure value) when sampling is performed 8 times per period are shown below the triangular waves. In FIGS. *6a–6d*, the average value of the waveform is made to successively increase by a value of ¼ bit. The vertical dashed lines indicate the points in time at which the air pressure is sampled. When the output of the A/D converter 203 is multiplied by 4 to obtain a 10-bit output, subjected to digital filtering, and then averaged, the resulting averages are 4m−2, 4m −1, 4m, and 4m +1 as shown at the bottom of FIG. 6. Thus, an air pressure change corresponding to ¼ bit of the output of the A/D converter 203 resulted in a 1 bit change in the 10-bit averaged output. This is the same degree of resolution which could be obtained using a 10-bit A/D converter. Thus, using an 8-bit A/D converter 203, it is possible to attain the same effective resolution as for a much more expensive 10-bit A/D converter.

The effective resolution varies depending on the frequency of sampling and on the amplitude and waveform of the analog pressure signal. However, in a speed range near idling in which particularly fine resolution is needed, the rotational speed of the engine is low, so the period of ripples is long. Therefore, a sampling period of around 6 msec is fully adequate to obtain resolution corresponding to 10 bits. For example, if the rotational speed of an engine during idling is 700 rpm, the period of ripples in the air intake pipe pressure is 43 msec. Therefore, if the sampling period is 6 msec it is possible to perform sampling approximately 7 times per period.

What is claimed is:

1. A fuel controller for an engine equipped with a pressure sensor which generates an analog signal corresponding to the pressure in an air intake pipe of the engine, the fuel controller comprising:

an N-bit A/D converter which performs A/D conversion of the analog signal of the pressure sensor and generates an N-bit digital signal;

multiplying means for multiplying the N-bit digital signal by a prescribed constant to obtain a digital output signal having at least (N +1) bits;

a low-pass digital filter which filters the output signal of said multiplying means and generates a filtered output; and control means for controlling the operation of a fuel injector of the engine in accordance with the filtered output so as to obtain a desired air/fuel ratio.

2. A fuel controller as claimed in claim 1, wherein said A/D converter is an 8-bit A/D converter, and the prescribed constant is 4.

3. A fuel controller as claimed in claim 1, wherein said multiplying means comprises a microcomputer.

* * * * *